US006672223B1

(12) United States Patent
Date

(10) Patent No.: US 6,672,223 B1
(45) Date of Patent: Jan. 6, 2004

(54) HIGH-SPEED TRANSPORTATION MECHANISM ON RAIL TRACK

(75) Inventor: Gen Date, Nagaokakyo (JP)

(73) Assignees: Midori Date, Kyoto (JP); Kyoko Nakahigashi, Kyoto (JP); Junko Date, Hyougo (JP); Aiko Date, Kyoto (JP); Keitaro Date, Ishikawa (JP)

( * ) Notice: Subject to any disclaimer, the term of this patent is extended or adjusted under 35 U.S.C. 154(b) by 0 days.

(21) Appl. No.: 09/806,242

(22) PCT Filed: Sep. 2, 1999

(86) PCT No.: PCT/JP99/04778

§ 371 (c)(1),
(2), (4) Date: Mar. 28, 2001

(87) PCT Pub. No.: WO00/18629

PCT Pub. Date: Apr. 6, 2000

(30) Foreign Application Priority Data

Sep. 29, 1998 (JP) ..... H10-311549

(51) Int. Cl.[7] ..... B61B 13/04
(52) U.S. Cl. ..... 105/147; 104/106
(58) Field of Search ..... 104/106, 107, 104/111, 118, 121; 105/141, 147

(56) References Cited

U.S. PATENT DOCUMENTS 4,195,576 A * 4/1980 Gutridge ..... 105/147
4,620,486 A * 11/1986 Gronau et al. ..... 104/121
4,702,173 A 10/1987 Perrott
5,360,124 A * 11/1994 Wurzer et al. ..... 213/45

FOREIGN PATENT DOCUMENTS

JP H05-39602 A 2/1993
WO WO83/00466 A 2/1983

* cited by examiner

*Primary Examiner*—S. Joseph Morano
*Assistant Examiner*—Robert J. McCarry, Jr.
(74) *Attorney, Agent, or Firm*—Shinjyu Global IP Counselors, LLP

(57) ABSTRACT

A high-speed transportation mechanism on rail track, wherein sleepers 4 are laid out on gravel 5 on the ground. A first rail (mono rail) 3 for supporting the weight of a vehicle 1 is laid down on the sleepers 4. A second rail (guide rail) 7 is suspended from an upside-down L sectional shape column 8 at an upper position opposed to the lower position of the first rail 3, the vehicle 1 will not fall on its side because a wheel of a lower side carriage 2, is fitted closely to the first rail 3, and a wheel of an upper carriage 6 is fitted closely to the second rail 7. A plurality of vehicles 1 are connected to each other through couplers 9, whereby the vehicle 1 can be run safely and stably at high speeds on a centrifugally forced curved line because it can run at any inclination angle. Thus, risks such as yawing, rising, and derailing of the vehicle 1 can be reduced.

23 Claims, 5 Drawing Sheets

HIGH-SPEED TRANSPORTATION MECHANISM ON RAIL TRACK

TECHNICAL FIELD

The present invention relates to a high-speed transportation mechanism that uses rails. The present invention especially relates to a high-speed transportation mechanism that makes it possible to run vehicles on curved lines at a high speed.

The fields to which the transportation mechanism on a rail track of the present invention relates are transportation mechanisms that carry passengers and commodities, models, and toys thereof. Specifically, they are: JR lines (such as non-express lines, local lines, bullet train lines, etc.) and vehicles lines possessed by various railway companies for commercial purposes; subways, monorails, mountain rails, transport systems at attraction parks, such as roller coasters and sightseeing vehicles.

TECHNICAL BACKGROUND

In a conventional method or structure of a rail track transportation mechanism, partial improvements and modifications in performance have been made in the past. However, there have been no fundamental changes in method or structure. Namely, according to a conventional mechanism, two wheels run on two rails.

In the structure of the conventional transportation mechanism, since a lot of improvements have been made over many years, the vehicles currently run more or less at maximum speeds. Technically speaking, running the vehicles at higher speeds would be quite difficult. One of the reasons comes from the structure of two wheels on two rails. In cases that adhere to this structure, the possibility of overturning and the derailment increases when increasing the speed of the vehicles on commercial lines that have curves.

One of the impediments to running the vehicles at high speeds on curved lines is the problem of centrifugal force applied when running at high speeds. Due to this centrifugal force, a lateral force is applied to the rails and wheels, thereby generating yawing, rising, or vibration of the vehicles. This makes it impossible to ensure stable and safe running of the vehicles, thus derailment results.

This instability of the vehicles derives mainly from a slight gap between a wheel and a rail. But this gap is necessary for running the vehicles on curved lines. Thus, this problem cannot be solved, even if the manufacturing precision or the assembling precision is improved.

The reason why a gap is provided is to correct the difference between the inner wheel and the outer wheel on curved lines in order to make it possible to run the vehicles on curved lines either at a low speed or at a high speed. Therefore, the wheels and the rails are formed to have a unique shape. When these uniquely-shaped wheels and rails are combined, a proper gap (strictly speaking, there is a slack which functions as a continuous converter) is provided between the wheel and the rail. Since this gap is fundamental for running the vehicles, it cannot be removed.

The first objective of the present invention is to provide a safe and stable high-speed transportation mechanism. The second objective of the present invention is to provide a method for running the vehicles in a state in which speed is maintained, even if many curved lines are used and the curvature radius thereof is small. In other words, the present invention provides a high-speed transportation mechanism which can be constructed quite economically, and can use commonly existing railroad lines or lines equivalent to the existing railroad lines such as JR railroad (bullet trains or non-express lines, for example).

DISCLOSURE OF THE INVENTION

A rail track according to the present invention is for a type of vehicle that has a plurality of running wheels. The wheels are disposed linearly along a running direction at lower portions of a vehicle body. Guide members which are different from the running wheels are provided on upper portions of the vehicle body. The rail track includes a first rail and a second rail.

The first rail determines the running direction of the vehicle and the running wheels run thereon. The second rail is engaged with the guide member so as to control the running posture of the vehicle. The second rail is disposed along the first rail so that it opposes the first rail.

A vehicle of the present invention has a first rail and a second rail. The first rail is disposed on a ground and defines the running direction of the vehicle. The second rail is disposed along and above the first rail so that the second rail opposes the first rail. The vehicle runs on a railed track that includes straight lines and curved lines. The curved lines of the second rail are displaced toward the center of the curved lines relative to curved lines of the first rail. The vehicle includes a vehicle body, a plurality of running wheels, and a plurality of guide members. The plurality of running wheels rotates while being supported by the first rail. The running wheels are provided linearly below the vehicle body in the running direction of the vehicle. The plurality of guide members control the running posture of the vehicle by engaging with the second rail. The guide members are provided linearly above the vehicle body in the running direction of the vehicle. The guide members are movable in a left-right direction perpendicular to the running direction of the vehicle with regard to the vehicle body.

A transportation mechanism in railed track of the present invention includes a railed track that includes straight lines and curved lines and a vehicle running on the railed track. The railed track includes a first rail and a second rail. The first rail is disposed on the ground and defines the running direction of the vehicle. The second rail is disposed along and above the first rail so as to oppose the first rail. The curved lines of the second rail are displaced toward the center relative to curved lines of the first rail. The vehicle includes a vehicle body, a plurality of running wheels, and a plurality of guide members. The plurality of running wheels rotates while supported by the first rail. The running wheels are provided linearly below the vehicle body in the running direction of the vehicle. The plurality of guide members controls the running posture of the vehicle by engaging with the second rail. The guide members are provided linearly above the vehicle body in the running direction of the vehicle. The guide members are movable in a left-right direction perpendicular to the running direction of the vehicle with regard to the vehicle body.

THE PREFERRED EMBODIMENTS FOR PRACTICING THE PRESENT INVENTION

Figure 1:
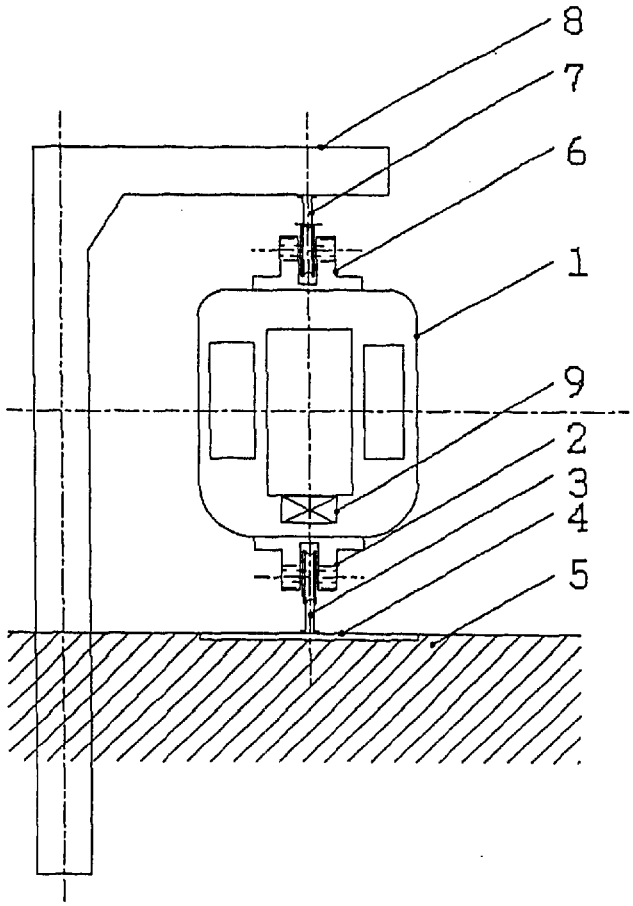
FIG. 1 a front view of a transportation mechanism according to a first embodiment of the present invention.
Figure 2:
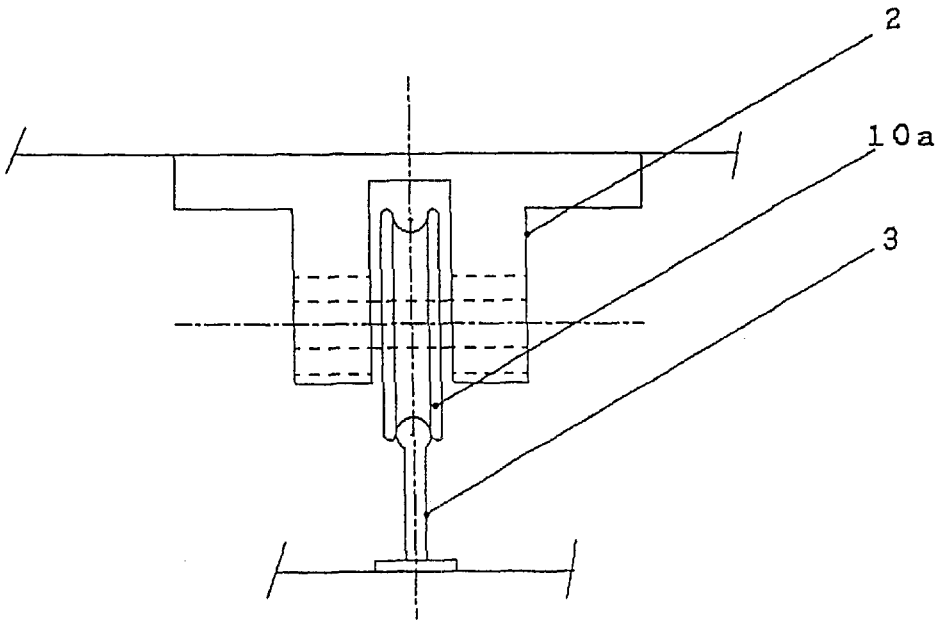
FIG. 2 is an enlarged view of a rail and the wheel in FIG. 1.
Figure 3:
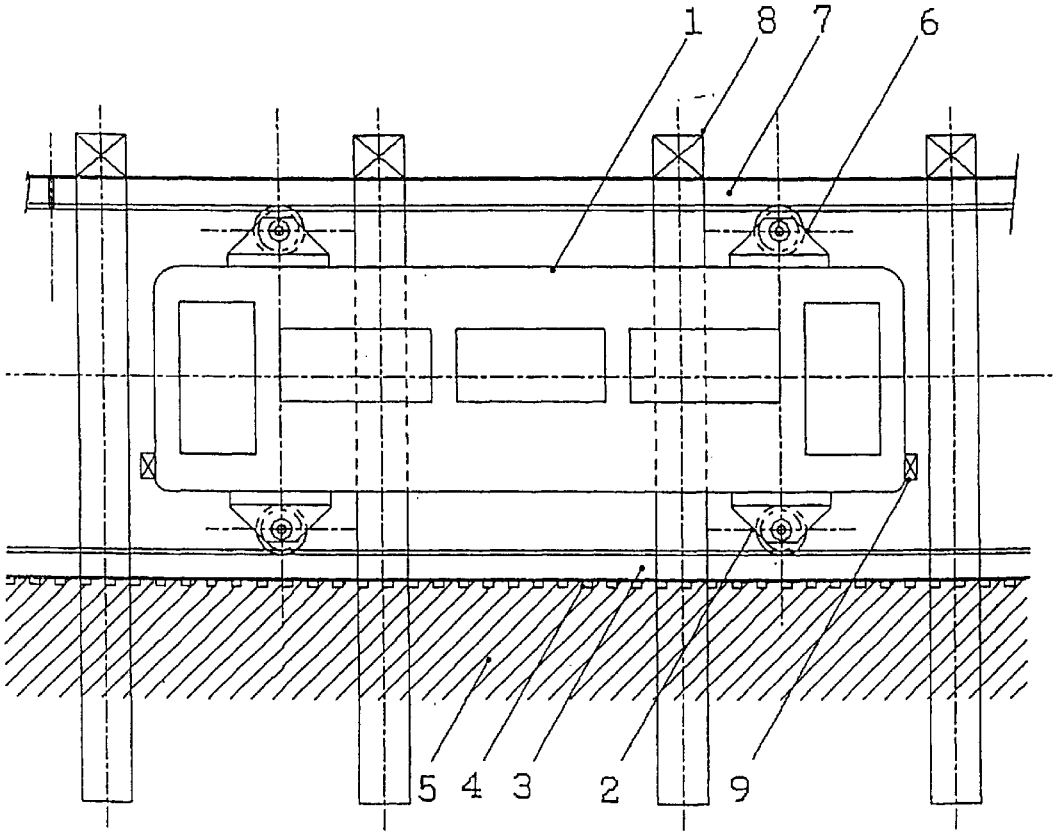
FIG. 3 a side view of the transportation mechanism according to the embodiment of FIG. 1.

An embodiment of the high-speed transportation mechanism according to the present invention will be explained below with reference to the drawings. FIG. 1 is a front view of a first embodiment of the high-speed transportation mechanism according to the present invention. FIG. 3 is a side view thereof. FIG. 2 is an enlarged view of a rail portion and a wheel portion under a floor of a vehicle.

As shown in FIGS. 1, 2, and 3, in the first embodiment of the present invention, numeral 1 designates a vehicle, numeral 2 is a carriage fixed below a floor of the vehicle 1. Numeral 10*a* is a wheel supported rotatably by the carriage 2. Numeral 3 is a first rail (a lower rail), numeral 4 is a sleeper, numeral 5 is gravel, numeral 6 is a carriage fixed above the roof of the vehicle 1. Numeral 10*b* is a wheel (an upper wheel) supported rotatably by the carriage 6, numeral 7 is a second rail (an upper wheel), and numeral 8 is a column.

As shown in FIGS. 1 and 3, sleepers 4 are laid substantially at equal intervals on the gravel 5. The first rail 3 is laid substantially on the center of the sleepers 4. As seen in FIG. 2 a head portion 3*a* of the first rail 3 is a portion contacted with the wheels. The head portion 3*a* is formed so that the cross section thereof is substantially round as shown in FIG. 2.

Figure 4:
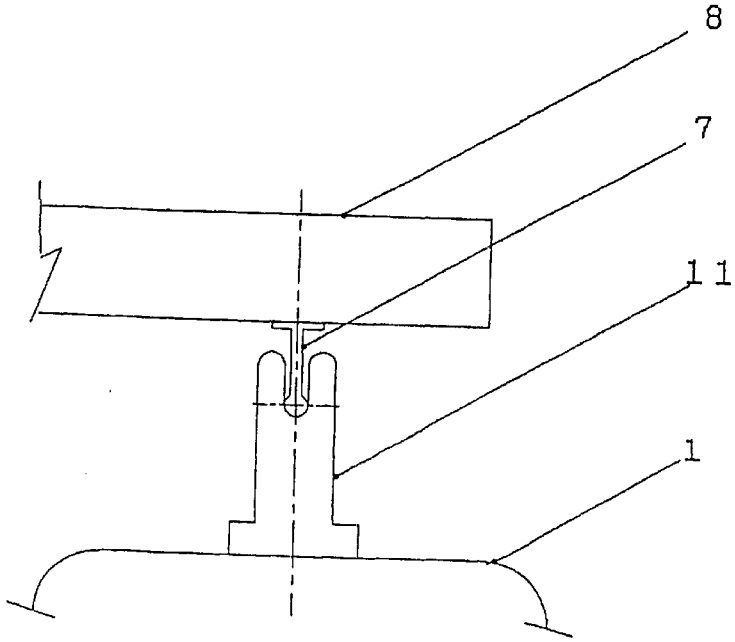
FIG. 4 an enlarged view of a roof portion of a vehicle according to a second embodiment of the present invention.

Referring to FIG. 1, on the other hand, the cross section of the column 8 is shaped like an upside-down L. Foot portions of the columns 8 are embedded in the earth. The second rail 7 is suspended opposite to the first rail 3 by the columns 8. Further, as seen in FIG. 4, a head portion 7*a*, a bottom portion of the second rail 7, is a portion contacted with the wheels. The cross section of the head portion of the second rail is formed to be substantially round like the first rail 3.

As seen in FIG. 1, a carriage 2 and a wheel 10*a* are attached below the floor of the vehicle 1. A carriage 6 and a wheel 10*b* are attached on the roof of the vehicle 1. The carriage 2 and the wheel 10*a* below the floor are disposed on the first rail 3. The first rail 3 holds the weight of the vehicle 1.

As shown in FIGS. 1 and 2, the cross section of the peripheral surface of the wheel 10*a* is formed to have a semi-circular concave portion so as to engage the head portion 3*a* of the first rail 3. Likewise, the cross section of the peripheral surface of the wheel 10*b* is formed to have a semi-circular concave portion so as to engage the head portion 7*a* of the second rail 7. As seen in FIG. 3, note that the lower carriage 2 and the wheel 10*a*, and the upper carriage 6 and the wheel 10*b* are provided with at least 2 sets per vehicle.

In FIG. 3, numeral 9 designates a coupler. It is possible to connect a plurality of vehicles 1 by the coupler 9.

As in the first embodiment of the present invention, since the lower carriage 2 and the wheel 10*a* are engaged with the first rail 3, and the upper carriage 6 and the wheel 10*b* are engaged with the second rail 7, the vehicle 1 does not overturn.

FIG. 4 is an enlarged cross sectional view of the vehicle roof viewed from the front of the high-speed transportation mechanism according to a second embodiment of the present invention. In the second embodiment, instead of the carriage 6 having the wheel 10*b* as in the first embodiment, a pulley 11 having a groove is attached. Since other parts are configured the same as in the first embodiment, the explanation thereof is omitted.

As shown in FIG. 4, the groove-shaped pulley 11 is provided on the roof of the vehicle 1. The bottom surface of the groove-shaped pulley 11 is formed to engage with the lower surface of the rail 7. In addition, at least two groove-shaped pulleys 11 are provided in one vehicle 1. Also, the lower carriage 2 and the wheel 10*a* can be replaced with the above described groove-shaped pulley 11.

As in the second embodiment of the present invention, since the lower carriage 2 and the wheel 10*a* (or the groove-shaped pulley) are engaged with the first rail 3, and the groove-shaped pulley 11 is engaged with the second rail 7, the vehicle 1 does not overturn.

Figure 5:
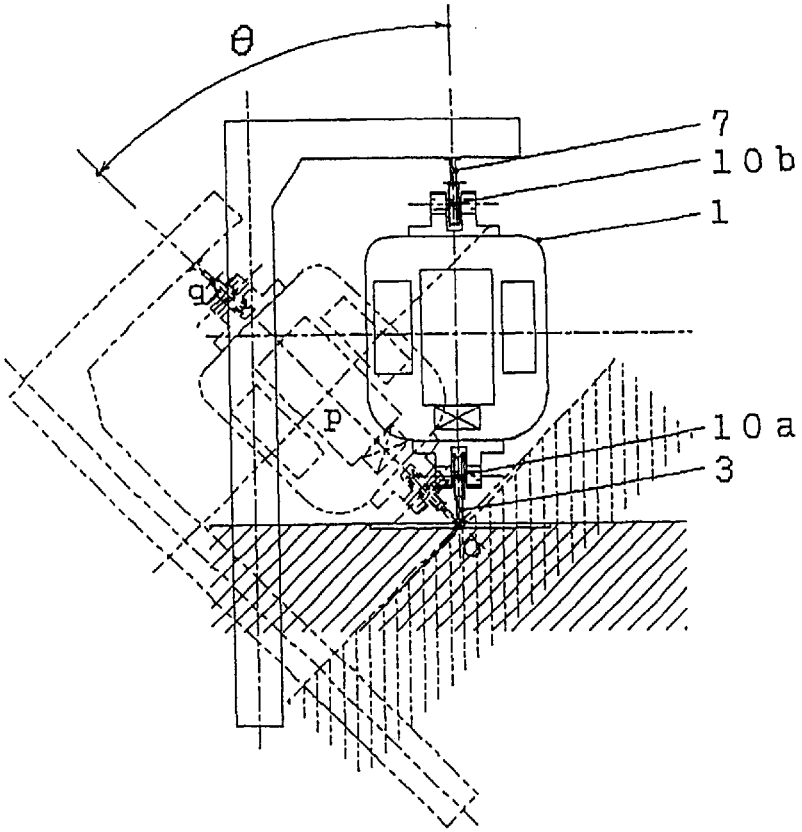
FIG. 5 is a view showing a state of inclination of the vehicle running on a curved line.

Next, as a third embodiment of the present invention, a case in which a vehicle is run on curved lines at high speed is explained. As shown in FIG. 5, when the vehicle runs on curved lines, the second rail 7 is disposed in an inner side of the curve so that the vehicle 1 can be inclined at a suitable angle θ in accordance with the velocity of the vehicle and the curvature radius of the curved lines.

Figure 6:
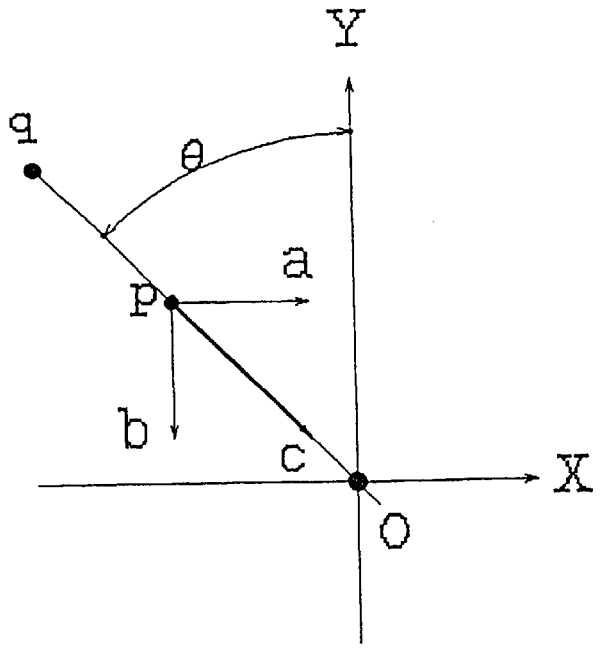
FIG. 6 an explanatory view of the direction of the force applied to the vehicle running on a curved line.

If the rail is disposed in this way, as shown in FIG. 6, a compound force c of the centrifugal force a and the gravity b generated when the vehicle is run on curved lines can be directed constantly to the center of the vehicle, namely constantly and vertically to the lower wheel 10*a*.

In this case, the centrifugal force a is proportional to a square of a velocity V of the vehicle, and is inversely proportional to a curvature radius r of the curved lines. In FIG. 6, the axis Y of the ordinate designates a direction of the gravity. The axis X of the abscissa designates a direction of the centrifugal force. p is a gravity center of the vehicle 1. o is a position of the first rail 3. q is a position of the second rail 7. Therefore, as shown in FIG. 6, even when the vehicle is run on curved lines at high speed, no lateral force is applied to the vehicle and to the passengers or commodities in the vehicle. Only the force in vertical direction (direction of angle θ) is applied to the floor of the vehicle, so that the vehicle can run on curved lines at high speed.

It is possible to replace the carriage 6 and the wheel 10*b* with a pulley 11 having a groove as in the second embodiment.

In the transportation mechanism shown in the above described FIG. 5 (according to the third embodiment of the present invention), the angle θ in accordance with the velocity V of the vehicle and the curvature radius r is previously set. Namely, since the position of the second rail is fixed, the angle θ is also fixed. Therefore, in order to keep the compound force c of the centrifugal force a and the gravity b to direct constantly downward, the vehicle must be run at a constant velocity. However, in the actual running, there are impediments like a bad weather, which make it impossible to maintain constant vehicle velocity. As a fourth embodiment, using FIGS. 7 and 8, a case in which the inclination angle θ of the vehicle is arbitrarily changed so that the compound force c of the centrifugal force a and the gravity b directs constantly to the center of the vehicle, that is downward, will be explained.

Figure 7:
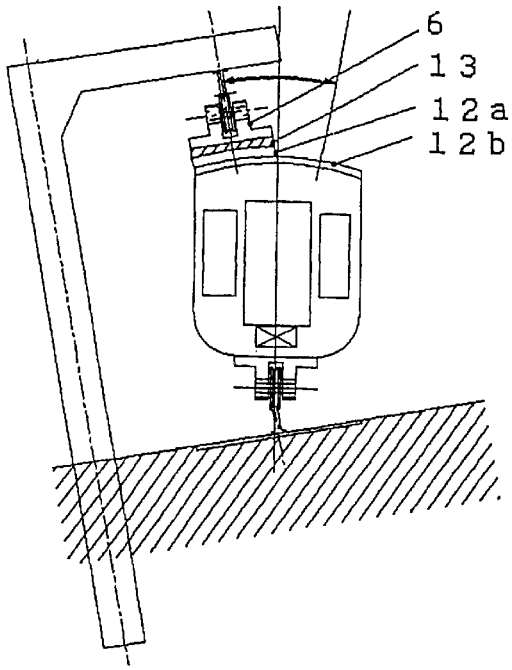
FIG. 7 is a front view showing the state of making the vehicle inclined in arbitrary angles by moving the lower portion of a carriage on the roof according to a fourth embodiment of present invention.

As shown in FIG. 7, in the fourth embodiment of the present invention, an upper carriage base 12*a* is attached to a lower portion of the carriage 6. The upper carriage base 12*a* is provided on a lower carriage base 12*b*. The lower carriage base 12*b* is fixed on a roof of the vehicle 1. The upper carriage base 12*a* is movable in a lateral direction (the direction of the arrow) on the lower carriage base 12*b*. The wheel 10*b* supported by the carriage 6 is electrically insulated from a vehicle body by an insulator 13. Due to this structure, when the vehicle is driven by a motor, the second rail can be electrically insulated from the ground. Thus, it is possible to take the electric current through the wheel 10*b* on the roof by supplying the electric current to the second rail.

In this structure, since the wheel 10*b* supported by the carriage 6 is movable together with the upper carriage base 12*a* in the arrow-marked direction, even when the velocity is changed, the inclination angle θ of the vehicle can be changed so that the compound force c of the centrifugal force a and the gravity b directs constantly downward to the center of the vehicle. The moving control of the upper carriage base 12*a* is performed by a sensor for detecting the velocity of the vehicle and the moving control means. The moving control means determines the moving position of the upper carriage base 12*a* in a lateral direction basing on the result of the sensor.

Figure 8:
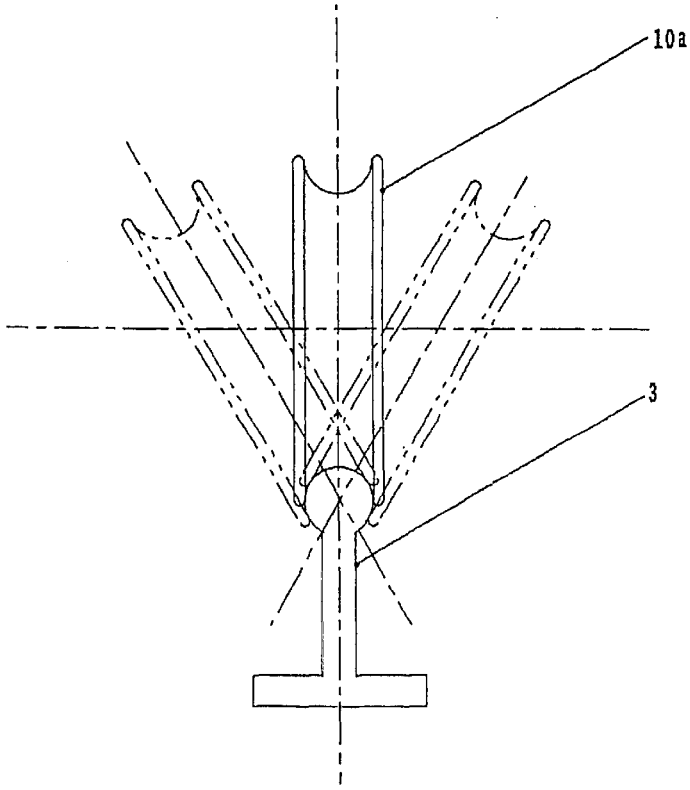
FIG. 8 is a sectional view of the first rail and the wheel according to the fourth embodiment oft present invention.

In the fourth embodiment, since the inclination angle θ of the vehicle changes in accordance with the velocity V, as shown in FIG. 8, it is necessary that the cross-sectional shape of a surface of the first rail contacting with the wheel is a convex circle so as to engage with the wheel 10*a*, and that a cross-sectional shape of the wheel 10*a* for supporting the weight of the vehicle, which contacts with the first rail, is semicircular concave so as to engage with the first rail 3. By these shapes, the vehicle can be inclined smoothly in accordance with the inclination angle θ. Further, it is possible to set the angle of the wheel so that the lateral load applied to the wheel would be minimized. In FIG. 8, the cross sectional shape of the first rail 3 is a convex circle and the cross sectional shape of the wheel 10*a* for supporting the weight of the vehicle is a semicircular concave. Oppositely, the cross sectional shape of the first rail 3 can be a semicircular concave and the cross sectional shape of the wheel 10*a* for supporting the weight of the vehicle can be a convex circle.

In the fourth embodiment, the carriage 6 and the wheel 10*b* can be replaced with the pulley 11 having a groove as in the second embodiment. In this case, the pulley 11 is configured to be movable laterally to the second rail 7 on the roof of the vehicle.

Next, one example of a coupler 9 in the present invention will be explained.

Figure 9:
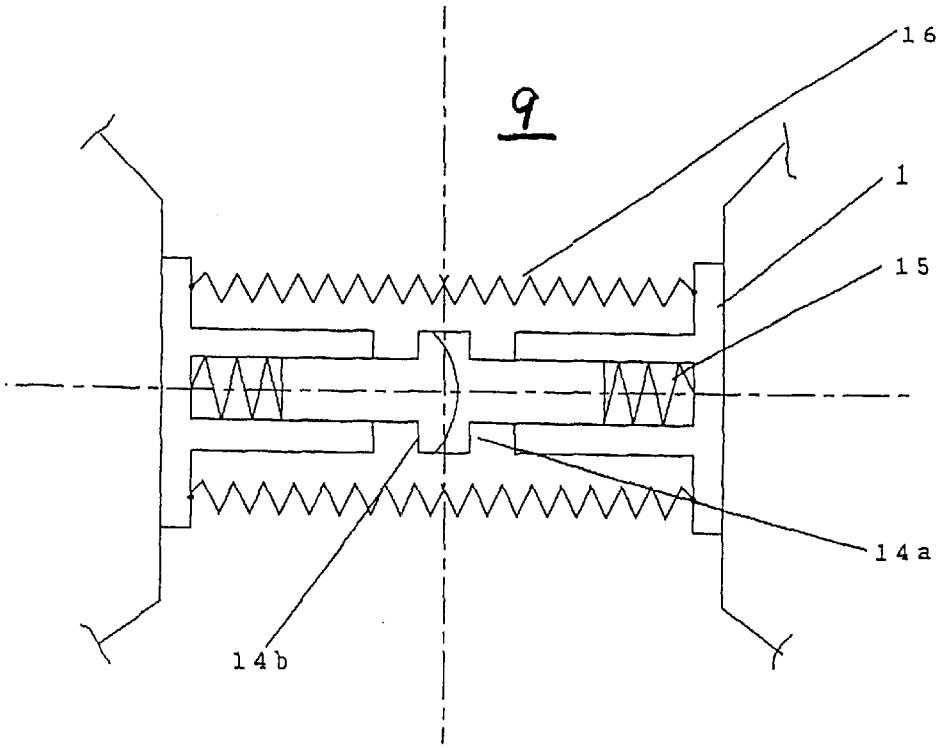
FIG. 9 is a view showing an example of a coupler of the transportation mechanism according to the present invention.

FIG. 9 shows an example of a coupler 9 of the present invention. In FIG. 9, numeral 1 designates a vehicle, 14*a* and 14*b* are rods of the connector, numeral 15 is a compressed spring, and numeral 16 is a pulling spring.

In FIG. 9, two pulling springs 16 are provided, but three or more pulling springs may be provided.

Figure 10:
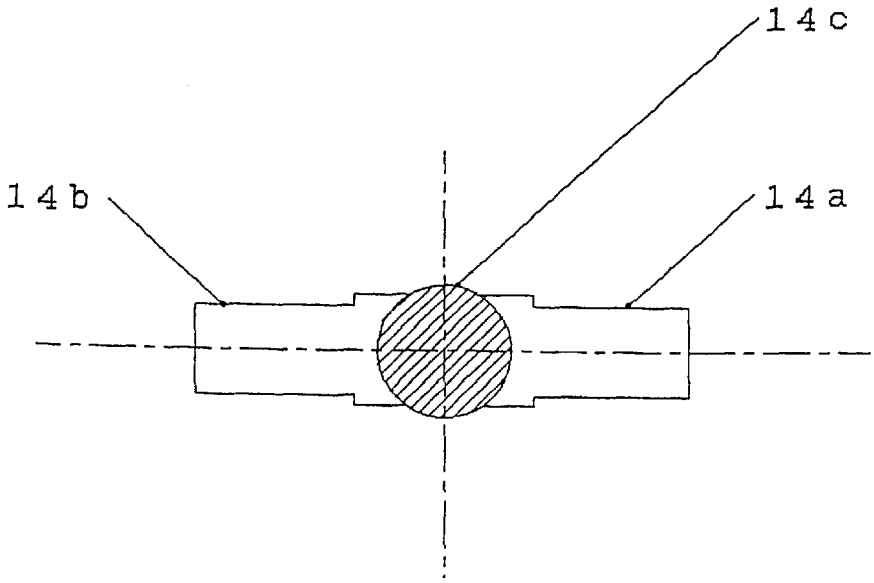
FIG. 10 is a view showing a modified example of a connecting rod in a coupler of the transportation mechanism according to the present invention.

Also in FIG. 9, the connector rod 14*a* has a semicircular concave shape, and the connector rod 14*b* has a semicircular convex shape. The connector rods 14*a* and 14*b* are engaged with each other. However, the coupler 9 of the present invention is not limited to this structure. For example, as shown in FIG. 10, there may be a spherical ball 14*c* sandwiched between the connecting rods 14*a* and 14*b*, each having a semicircular concave shape. That is, the structure may be preferable as long as two connected vehicles can be directed in all directions making the contact point of the coupler as a fulcrum, and the rotation (twist) angle can be changed freely.

By the above described structure of the coupler 9, the angle of the running direction of the two vehicles can be swung in all directions without being separated from each other making the contact point of the coupler as a fulcrum. Additionally, the inclination angles of the two vehicles can be set individually without twisting of the vehicle 1 in curved lines. This is because the connector portion has a function of rotating with regard to the inclination between the vehicles.

Due to the construction of such a coupler, when a plurality of vehicles are run in curved lines in the third and fourth embodiments, each vehicle can be inclined individually in a state that a plurality of vehicles are connected so as to set the appropriate angle θ in accordance with the running velocity V of the vehicle and the curvature radius r of the curved line.

Note that the cross-sectional shape of a head portion of each rail and a head portion of wheels are not restricted to the above described embodiments. They may be a combination of a cross-sectional shape of a triangle or the like and a curved surface.

POSSIBILITY OF INDUSTRIAL APPLICABILITY

According to the above described methods and configuration of the present invention, it is unnecessary to consider the differences between the inner wheel and the outer wheel in curved lines. Thus, a gap between the rail and the wheel can be minimized. Namely, the yawing of the vehicle is prevented.

In addition, by disposing the second rail which is provided upward, inside of the curved line, and by moving the wheels on the roof laterally, the vehicle can be run inclined at an arbitrary angle. Therefore, the generated centrifugal force can be directed constantly to the center of the vehicle, that is, constantly and vertically to the wheel. Thus, due to this structure, vehicles can be run at a high speed on curved lines and vibration generation or lateral force will be suppressed. Further, since the vehicle is provided between the upper rail and the lower rail, there is no rising of the vehicle and the possibility of derailing the vehicle is reduced.

According to the present invention, the width between the wheels is actually a distance between the wheel below the floor and the wheel above the roof. This distance is longer than that of the vehicle in the prior art. In other words, it is possible to make the wheel interval (the distance between the lower rail and the upper rail) over 4 meters compared to 1.5 meters or so in the prior art, reducing the yawing of the vehicle.

Further, since the centrifugal force on curved lines is applied downward and vertically to the floor, riding in the vehicle is comfortable.

Since high-speed, stability, and safety are maintained in the high speed transportation mechanism of the present invention, there is no problem to lay rails having many curved lines. Consequently, the present invention makes it possible to lay rails even at places where providing straight rails is difficult because of natural or legal impediments, by avoiding those impediments. This means that it is possible to lay the rails easily on mountains, in the interior of Japan, in suburbs, at the side of highways, or underground.

Considering the necessary technology to achieve this system of the present invention, much of the conventional technology is partially applicable, so that there are no problems or difficulties to commercialize it. Namely, there is no technological or legal, customary limitation to manufacture or operate a facility in order to supply the system of the present invention as an applicable system in the world.

Further, the effect to the environment of this invention is considered to be not more than that of conventional railed transportation mechanisms such as JR bullet trains.

What is claimed is:

1. A vehicle running on a railed track having straight lines and curved lines, the railed track including a first rail disposed on a ground for defining a running direction of the vehicle, and a second rail disposed above and along the first rail so as to oppose the first rail, curved lines of the second rail being displaced at a center side relative to curved lines of the first rail, the vehicle comprising:

a vehicle body;

a plurality of running wheels being rotatably supported by the first rail, said running wheels being provided below said vehicle body linearly in the running direction of the vehicle, said plurality of running wheels having a concave portion on an outer periphery of said plurality of running wheels, said concave portion being concave relative to said outer periphery, said concave portion being circular and being configured to maintain continuous contact with a circular head portion of the rail as an axis of rotation of said plurality of running wheels tilts relative to the rail; and a plurality of guide members being configured to control a running posture of the vehicle by engaging with the second rail, said plurality of guide members being provided above said vehicle body linearly along the second rail, said plurality of guide members being movable in a left-right direction perpendicular to the running direction of the vehicle with regard to said vehicle body.

2. A vehicle according to claim 1, wherein said plurality of guide members are wheels provided rotatably above said vehicle body.

3. A vehicle according to claim 1, wherein said plurality of guide members are pulleys having a groove being configured to engage the second rail, said pulleys being provided above said vehicle body.

4. A vehicle according to claim 1, wherein a cross-sectional shape of a surface contacted with said running wheels of the first rail is concave or convex, wherein a cross-sectional shape of an outer peripheral surface of said running wheels is convex or concave being able to engage with the first rail, and said running wheels are engagable with the first rail at an arbitrary angle.

5. A vehicle according to claim 1, further comprising a mechanism in which said guide members are movable in a direction perpendicular to the running direction of the vehicle with regard to said vehicle body, wherein the inclination angle of the vehicle can be controlled arbitrarily by said mechanism, and wherein the vehicle is run in a state of being inclined inside of the curved lines when it runs on the curved lines so that the compound force of the centrifugal force and gravity applied to the vehicle is directed vertically to a floor of the vehicle.

6. A transportation mechanism on a railed track having straight lines and curved lines, and a vehicle running along the railed track, the railed track comprising:

a first rail being provided on a ground and defining a running direction of the vehicle, said first rail having a circular head portion; and a second rail being provided above and along said first rail, said second rail being configured to oppose said first rail, curved lines of said second rail being displaced at a center side of the curved lines relative to curved lines of said first rail; and the vehicle comprising, a vehicle body, a plurality of running wheels being rotatably supported by said first rail, said plurality of running wheels having a concave portion on an outer periphery of said plurality of running wheels, said concave portion being concave relative to said outer periphery, said concave portion being circular and being configured to maintain continuous contact with said circular head portion of said first rail as an axis of rotation of said plurality of running wheels tilts relative to said first rail, said running wheels being provided below said vehicle body linearly along said running direction of the vehicle, and a plurality of guide members being configured to control a running posture of the vehicle by engaging with said second rail, said plurality of guide members being provided above said vehicle body linearly along said running direction of the vehicle, said plurality of guide members being movable in a left-right direction perpendicular to said running direction of the vehicle with regard to said vehicle body.

7. A transportation mechanism on railed track according to claim 6, further comprising a connector mechanism for connecting adjacent vehicles, said connector mechanism being movable and rotatable in all directions and being rotatable to an inclination angle between two of said adjacent vehicles.

8. A transportation mechanism comprising: a railed track comprising, a first rail being provided on a ground and defining a running direction of the vehicle, said first rail having a circular head portion, said first rail having first straight and first curved lines; and a second rail provided above and along said first rail, said second rail being configured to oppose said first rail, said second rail having second straight and second curved lines, said second straight lines being arranged substantially directly above said first straight lines relative to a force vector of the gravity of earth, said second curved lines being displaced circumferentially on a concave side of said first curved lines relative to a force vector of the gravity of earth; and a vehicle comprising, a vehicle body, a plurality of running wheels being rotatably supported by said first rail, said plurality of running wheels having a concave portion on an outer periphery of said plurality of running wheels, said concave portion being concave relative to said outer periphery, said concave portion being circular and being configured to maintain continuous contact with said circular head portion of said first rail as an axis of rotation of said plurality of running wheels tilts relative to said first rail, said running wheels being provided below said vehicle body linearly along said running direction of the vehicle, and a plurality of guide members being configured to control a running posture of said vehicle, said plurality of guide members being configured to engage said second rail, said plurality of guide members being provided above said vehicle body linearly along said running direction of the vehicle, said plurality of guide members being movable in a left-right direction perpendicular to said running direction of said vehicle with regard to said vehicle body.

9. The transportation mechanism according to claim 8, wherein said vehicle further comprises a connector mechanism for connecting an adjacent vehicle having said connector mechanism, said connector mechanism being movable and rotatable in all directions.

10. The transportation mechanism according to claim 9, wherein said connector mechanism comprises, a first connector rod that has a semicircular concave shape, said first connector rod is arranged to extend from said vehicle in a first direction, a second connector rod that is configured to connect to said first connector rod of said adjacent vehicle, said second connector rod extends from said vehicle in a second direction substantially opposite to said first direction, and pulling and compressing springs.

11. The transportation mechanism according to claim 10, wherein said second connector rod has a semicircular concave shape and a spherical ball that is arranged to be sandwiched between said first connector rod and said second connector rod.

12. The transportation mechanism according to claim 10, wherein said second connector rod has a semicircular convex shape that is arranged to connect directly to said first connector rod.

13. The transportation mechanism according to claim 8, wherein said first rail further comprises a head portion that is configured to be substantially round in a direction substantially perpendicular to said running direction, said plurality of running wheels having a outer periphery that is concave in said direction substantially perpendicular to said running direction, said plurality of running wheels are configured to contact said head portion.

14. The transportation mechanism according to claim 13, wherein a roof of said vehicle is convex in a direction toward said second rail, and said plurality of guide members are configured to move on said roof in said left-right direction perpendicular to said running direction.

15. The transportation mechanism according to claim 14, wherein control of moving said plurality of guide members in said left-right direction perpendicular to said running direction of said vehicle is performed by a sensor and a moving control mechanism, said sensor is configured to detect a velocity of said vehicle, and said moving control mechanism is configured to determine a moving position of the vehicle based on a result of said sensor.

16. The transportation mechanism according to claim 15, wherein said plurality of guide members are pulleys having a groove being configured to engage said second rail, said pulleys being provided above said vehicle body.

17. The transportation mechanism according to claim 16, wherein said second rail has a head portion that has a round shape said direction substantially perpendicular to said running direction.

18. The transportation mechanism according to claim 15, wherein said plurality of guide members are guide member wheels being configured to engage said second rail, said pulleys being provided above said vehicle body.

19. The transportation mechanism according to claim 18, wherein said guide members wheels have a groove being configured to engage said second rail.

20. The transportation mechanism according to claim 19, wherein said guide member wheels are electrically insulated from said vehicle body.

21. A vehicle running on a railed track having straight lines and curved lines, the railed track including a first rail disposed on a ground for defining a running direction of the vehicle, and a second rail disposed above and along the first rail so as to oppose the first rail, curved lines of the second rail being displaced at a center side relative to curved lines of the first rail, the vehicle comprising:

a vehicle body;

a plurality of running wheels being rotatably supported by the first rail, said running wheels being provided below said vehicle body linearly in the running direction of the vehicle; and a plurality of guide members being configured to control a running posture of the vehicle by engaging with the second rail, said plurality of guide members being provided above said vehicle body linearly along the second rail, said plurality of guide members being movable in a left-right direction perpendicular to the running direction of the vehicle with regard to said vehicle body, the first rail having a convex portion, said convex portion of the first rail being configured to contact a circular head portion of said plurality of running wheels, said circular head portion of said plurality of running wheels being concave relative to said convex portion and being configured to maintain continuous contact with said convex portion of the first rail as an axis of rotation of said plurality of running wheels tilts relative to the first rail.

22. A transportation mechanism on a railed track having straight lines and curved lines, and a vehicle running along the railed track, the railed track comprising:

a first rail being provided on a ground and defining a running direction of the vehicle; and a second rail being provided above and along said first rail, said second rail being configured to oppose said first rail, curved lines of said second rail being displaced at a center side of the curved lines relative to curved lines of said first rail; and the vehicle comprising, a vehicle body, a plurality of running wheels being rotatably supported by said first rail, said running wheels being provided below said vehicle body linearly along said running direction of the vehicle, and a plurality of guide members being configured to control a running posture of the vehicle by engaging with said second rail, said plurality of guide members being provided above said vehicle body linearly along said running direction of the vehicle, said plurality of guide members being movable in a left-right direction perpendicular to said running direction of the vehicle with regard to said vehicle body, said first rail having a convex portion, said convex portion of said first rail being configured to contact a circular head portion of said plurality of running wheels, said circular head portion of said plurality of running wheels being concave relative to said convex portion and being configured to maintain continuous contact with said convex portion of said first rail as an axis of rotation of said plurality of running wheels tilts relative to said first rail.

23. A transportation mechanism comprising:

a railed track comprising, a first rail being provided on a ground and defining a running direction of the vehicle, said first rail having first straight and first curved lines; and a second rail provided above and along said first rail, said second rail being configured to oppose said first rail, said second rail having second straight and second curved lines, said second straight lines being arranged substantially directly above said first straight lines relative to a force vector of the gravity of earth, said second curved lines being displaced circumferentially on a concave side of said first curved lines relative to a force vector of the gravity of earth; and a vehicle comprising, a vehicle body, a plurality of running wheels being rotatably supported by said first rail, said running wheels being provided below said vehicle body linearly along said running direction of the vehicle, and a plurality of guide members being configured to control a running posture of said vehicle, said plurality of guide members being configured to engage said second rail, said plurality of guide members being provided above said vehicle body linearly along said running direction of the vehicle, said plurality of guide members being movable in a left-right direction perpendicular to said running direction of said vehicle with regard to said vehicle body said first rail having a convex portion, said convex portion of said first rail being configured to contact a circular head portion of said plurality of running wheels, said circular head portion of said plurality of running wheels being concave relative to said convex portion and being configured to maintain continuous contact with said convex portion of said first rail as an axis of rotation of said plurality of running wheels tilts relative to said first rail.

* * * * *